US010000973B2

(12) United States Patent
Shotwell

(10) Patent No.: US 10,000,973 B2
(45) **Date of Patent: *Jun. 19, 2018**

(54) REAMER FOR USE IN DRILLING OPERATIONS

(71) Applicant: CHENGDU BEST DIAMOND BIT CO., LTD, Chengdu (CN)

(72) Inventor: Duane Shotwell, Conroe, TX (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/533,981

(22) Filed: Nov. 5, 2014

(65) Prior Publication Data

US 2016/0265280 A1 Sep. 15, 2016

(51) Int. Cl.

| | |
|---|---|
| ***E21B 10/26*** | (2006.01) |
| ***E21B 10/44*** | (2006.01) |
| ***E21B 7/128*** | (2006.01) |
| ***E21B 10/43*** | (2006.01) |
| ***E21B 10/56*** | (2006.01) |

(52) U.S. Cl.
CPC ..... *E21B 10/26* (2013.01); *E21B 7/128* (2013.01); *E21B 10/43* (2013.01); *E21B 10/44* (2013.01); *E21B 10/56* (2013.01)

(58) Field of Classification Search
CPC ..... E21B 10/26; E21B 17/1078
See application file for complete search history.

(56) References Cited

U.S. PATENT DOCUMENTS

| | | | | |
|---|---|---|---|---|
| RE36,817 E * | 8/2000 | Pastusek | ..... | E21B 10/26 175/334 |
| 6,182,754 B1 * | 2/2001 | Vermeeren | ..... | E21B 17/1071 166/176 |
| 8,607,900 B1 * | 12/2013 | Smith | ..... | E21B 10/26 175/323 |
| 2008/0264696 A1 * | 10/2008 | Dourfaye | ..... | E21B 10/573 175/428 |

FOREIGN PATENT DOCUMENTS

| | | | | |
|---|---|---|---|---|
| EP | 1811124 A1 * | 7/2007 | ..... | E21B 10/26 |

* cited by examiner

*Primary Examiner* — D. Andrews
*Assistant Examiner* — Kristyn A Hall
(74) *Attorney, Agent, or Firm* — Patrick Reilly

(57) ABSTRACT

An invented reamer provides an annular body supporting two or more blades wherein each blade includes a spiral section disposed between two tapered sections placed on an exterior of the body. The spiral section fixes a plurality of a one type of cutting insert, e.g., tungsten carbide inserts, and the two tapered sections may each fix cutting inserts of an alternate type, e.g., polydiamond inserts. Certain embodiments provide of the tapered sections have a first flat surface area that extends towards and away from a central longitudinal axis of the annular body and/or a second surface area that positions cutting surfaces of attached cutting inserts linearly along a line that intersects the central longitudinal axis.

13 Claims, 7 Drawing Sheets

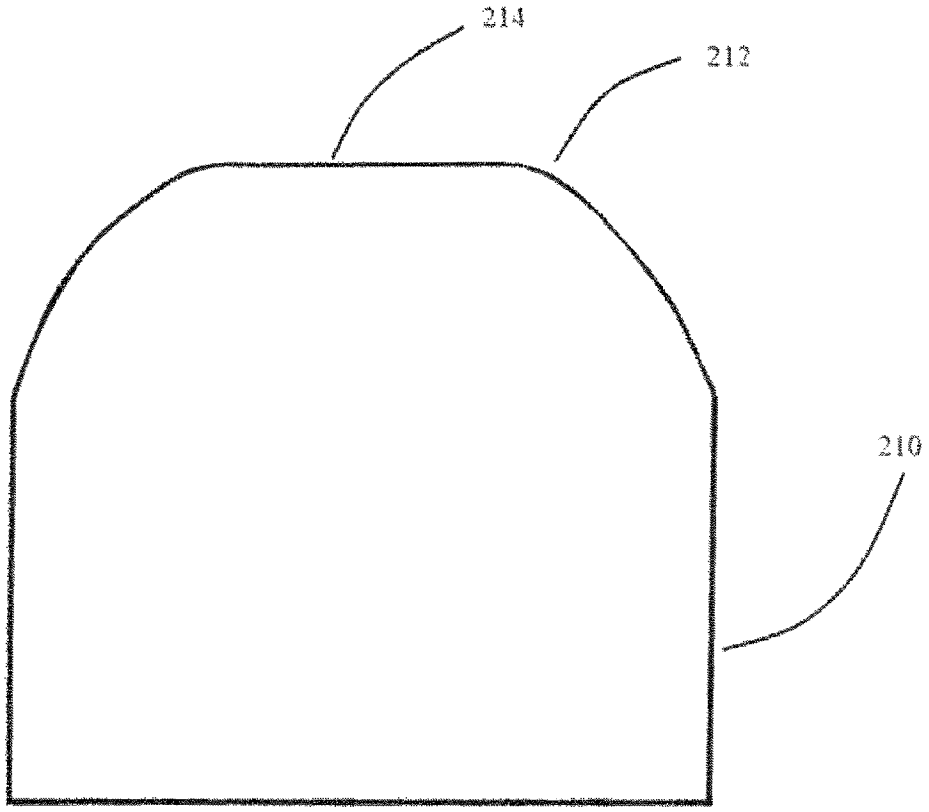
Figure 2A - Prior Art

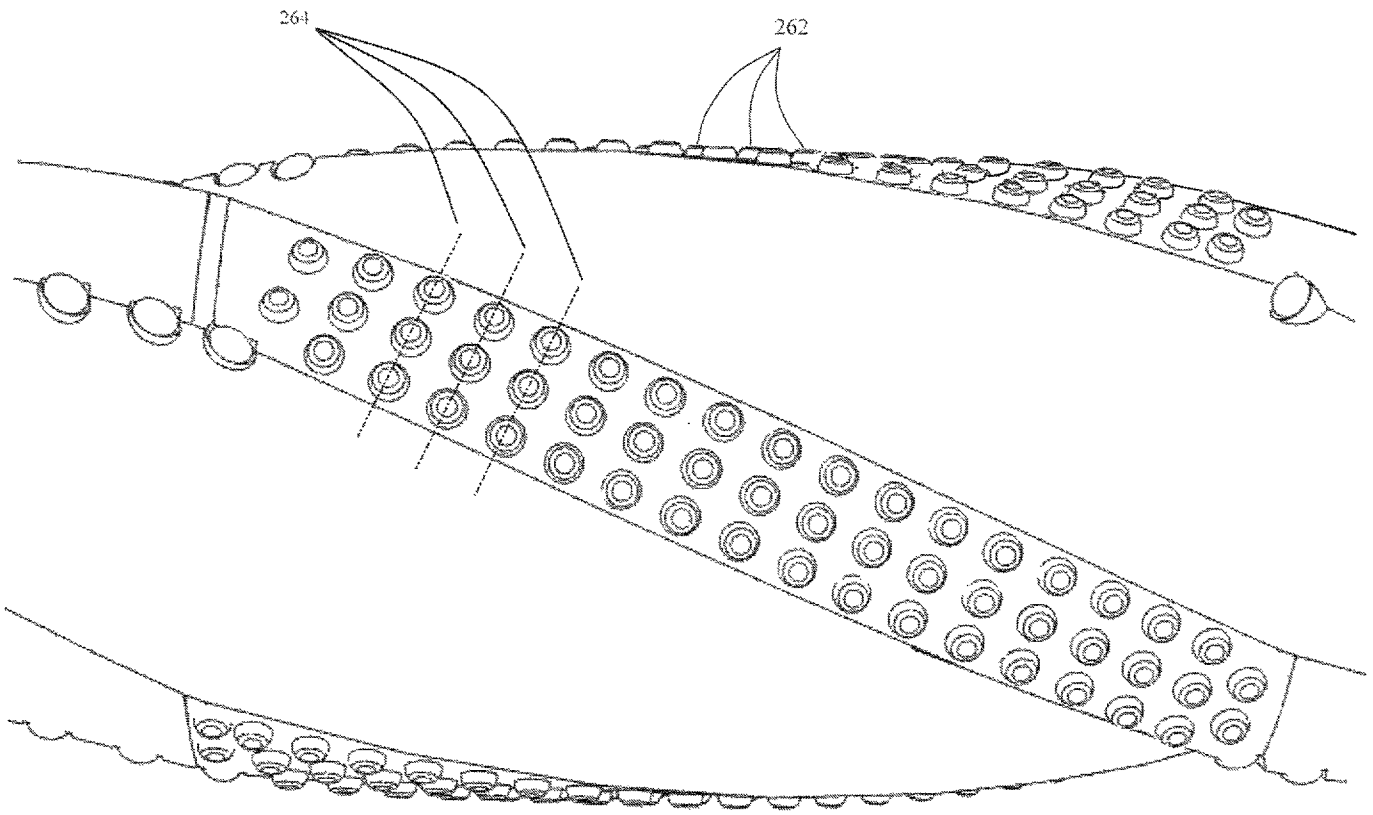
Figure 2D - Prior Art

Figure 3A - Prior Art
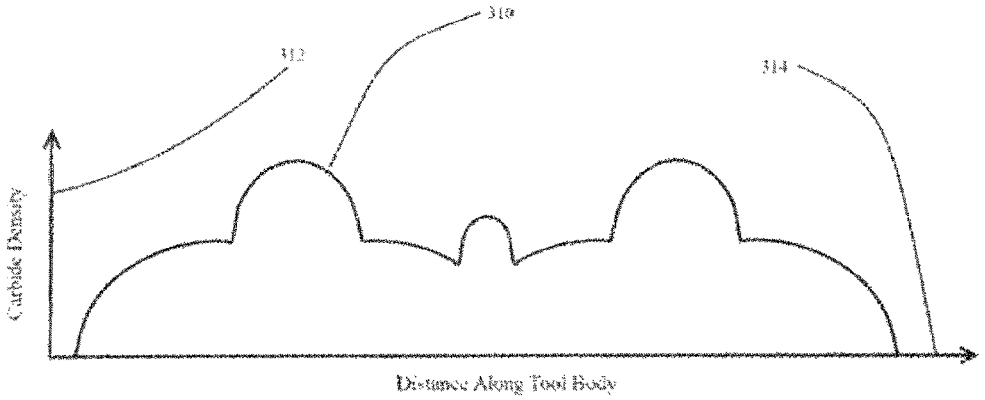
Figure 3B
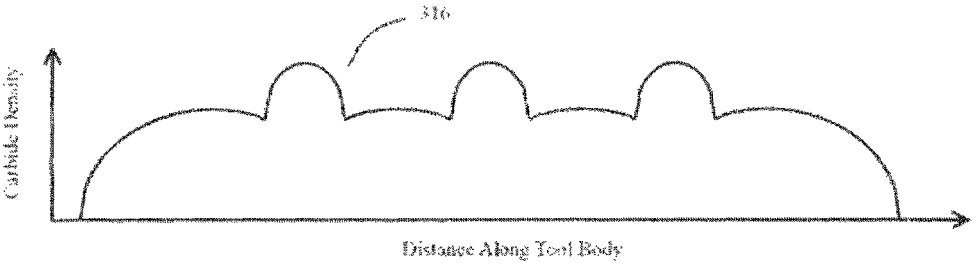
Figure 3C
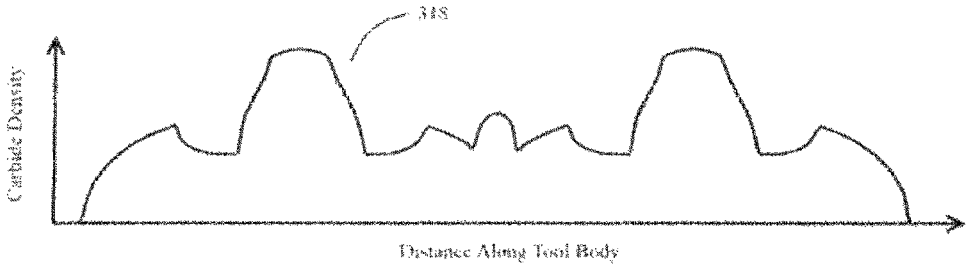
Figure 3D
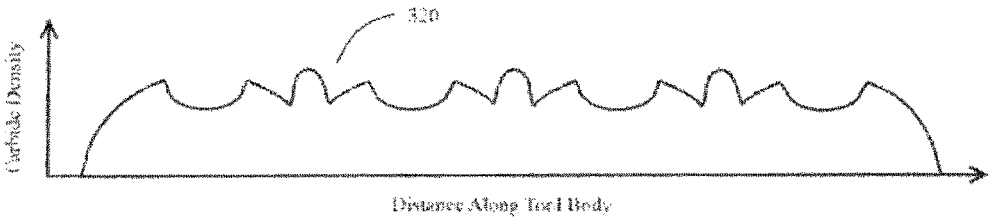

REAMER FOR USE IN DRILLING OPERATIONS

BACKGROUND OF THE INVENTION

Field of the Invention

The present invention relates to apparatus for use in the oil industry, and, more particularly, to a reamer for use in oil well drilling operations.

Description of the Prior Art

Wellbore reamers are known in the field of oil well drilling operations, and are used to open wellbores to allow for smooth operation of the drilling string. For example, U.S. Pat. No. 8,607,900 to Smith discloses a bi-directional reamer. Similarly, European Patent Application No. EP1811124 by Bassal, et al. discloses a similar type of reamer.

While they are useful tools, these types of reamers have maintenance requirements that can result in increased costs in drilling. Wear and tear on the cutters or the tool body can result in effective failure of the tool, which can then require pulling the drill string to replace the reamer. Some wear of the cutting bits on a reamer is expected, but the rate of wear can be exacerbated by the configuration of the tool. For example, the configuration of the blades on a reamer may direct drilling fluid away from, rather than over, the cutting elements, resulting in excessive wear due to heating. Thus, it is desirable to provide improved fluid flow over the cutting elements of a reaming tool.

Additionally, current reaming-while-drilling tools utilize flat cap tungsten carbide inserts as the primary cutting elements on the cylindrical outer diameter. It is desirable to provide an improved cutting element design to provide such a tool with greater efficiency. Similarly, current reamer designs place the tungsten carbide cutting inserts in simple rows and columns, which does not provide uniform distribution of the carbide against the hole wall. It is desirable to provide a reamer that aligns the cutting inserts so that there is more uniform coverage of the blade width.

Current reamer designs also utilize blades that are helical in shape. It is desirable to provide a reamer with an improved blade design, for purposes of improving fluid flow over the cutting inserts.

Current reamer designs also provide polycrystalline diamond cutters along portions of the blades. However current designs fail to balance the load on these cutters. It is thus desirable to allow for the implementation of back rake and side rake with polycrystalline diamond cutters. Providing such back rake and side rake improves drilling efficiency by providing better force balancing and load work distribution of the cutters regardless of their position.

SUMMARY OF THE INVENTION

The invention is a reaming tool implementing a unique blade design and preferably improved cutting element design. The invention comprises an tool body with a plurality of cutting blades extending outward from the tool body. For drilling operations, the tool body comprises an annular opening through which drilling fluid is pumped downhole, through the drillstring to the drill bit. Drilling fluid returns uphole along the exterior of the drillstring, providing lubrication and cooling.

The cutting blades of the present invention depart from prior designs by rising from either end of the tool in a linear, rather than spiral manner, then forming a helical section parallel to the tool body between the tapered ends. In a preferred embodiment, the helical portion of the cutting blades comprise tungsten carbide inserts of a unique design. These inserts are larger in diameter than standard inserts and provide a flat-topped "doughnut" design rather than current inserts' partially rounded, solid tops. Proper placement of the donut cutters results in a more uniform distribution of the carbide against the hole wall and also provides additional cutting edge surface against the hole wall.

Polycrystalline diamond cutters are provided along the tapered, linear portions of the cutting blades. The polycrystalline diamond cutters may be mounted with back rake or side rake (or both) to increase cutting efficiency and improve load distribution on these cutters.

BRIEF DESCRIPTION OF THE DRAWINGS

In the accompanying drawings:

FIG. 2A is a schematic side view of a prior art tungsten carbide cutting element.

FIG. 2D is a graphical plot of typical carbide cutting element surface distribution across the face of a typical prior art reaming tool.

FIG. 3A is a graphical plot of carbide cutting element surface distribution across the face of a prior art reaming tool.

FIG. 3B is a graphical plot of carbide cutting element surface distribution across the face of a prior art reaming tool but using the placement scheme of the present invention.

FIG. 3C is a graphical plot of carbide cutting element surface distribution across the face of a reaming tool using the cutting elements of the present invention but a standard placement scheme.

FIG. 3D is a graphical plot of carbide cutting element surface distribution across the face of a reaming tool of the present invention.

DETAILED DESCRIPTION OF SPECIFIC EMBODIMENTS

Figure 1:
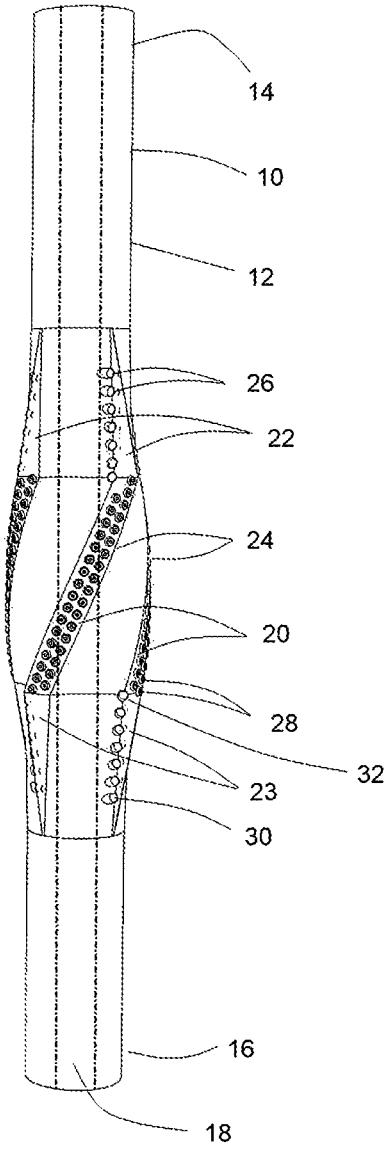
FIG. 1 is a side view of one embodiment of the present invention.

Referring to FIG. 1, a tool 10 of the present invention comprises a tool body 12 having a first end 14, a second end 16, an opening 18, and a plurality of cutting blades 20. First end 14 of tool 10 is "uphole," that is, closer to the surface via the borehole than second end 16. Drilling fluid is pumped downhole through the interior of the drilling string, flows through tool 10 through opening 18, and exits tool 10 at second end 16. As it returns uphole, the drilling fluid flows over the exterior of tool 10, providing lubrication and cooling for cutting blades 20.

Each of cutting blades 20 comprises a first and second linear tapered sections 22, 23 which rise from the body 12 to the desired cutting radius, and a constant radius spiral section 24. First cutting elements 26, preferably polycrystalline diamond cutters, are arrayed in a linear fashion along first and second linear tapered sections 22, 23, and second cutting elements 28, preferably tungsten carbide cutters, are arrayed on spiral sections 24.

The linear form of first and second linear tapered sections 22, 23 provide improved cleaning and cooling of the cutting elements arrayed thereon, because circulating fluid is forced directly over these cutting elements. Those of skill in the art will recognize that the arrangement of first cutting elements 26 and second cutting elements 28 will allow tool 10 to ream a borehole regardless of whether tool 10 is moving uphole or downhole. Additionally, first cutting elements 26 may be mounted with back rake, side rake, or both to increase cutting efficiency. (See FIG. 1A) Preferably, first cutting elements 26 are mounted with increasing back and side rake (relative to each other) in progression from the first cutter 30 closest to the tool body 12 to the last cutter 32 furthest from the tool body 12.

Figure 1A:
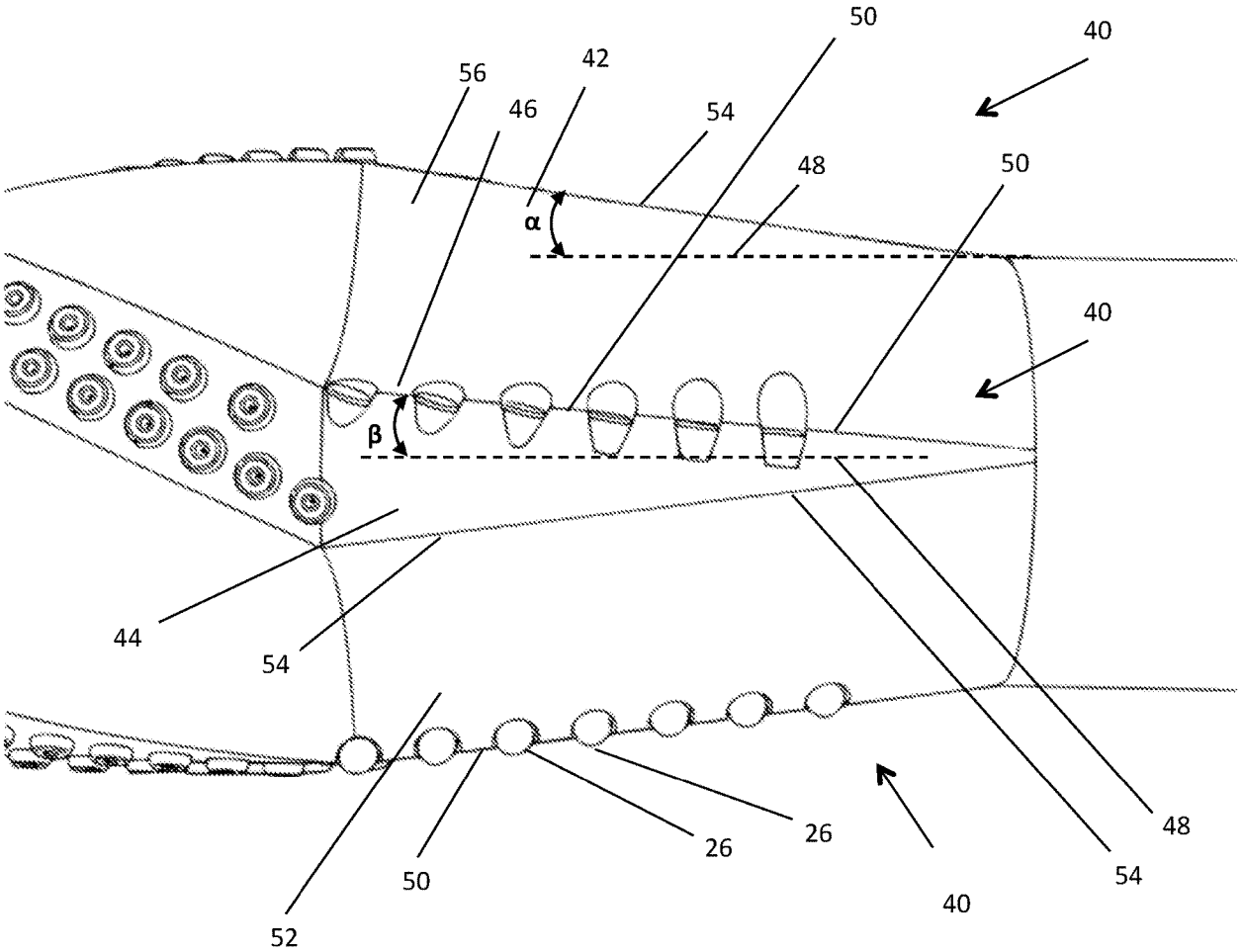
FIG. 1A is a plan view of a linear tapered section of FIG. 1, detailing the mounting of cutting elements thereon with back or side rake.

Referring to FIG. 1A, a linear tapered section 40 (corresponding to one of linear tapered sections 22 or 23 of FIG. 1) is shown. First cutting elements 26 are mounted thereon, and may be mounted to each form a separate angle .alpha. 42 relative to a top face 44 of the linear tapered section 40 and a centerline of the tool 48. Additionally, first cutting elements 26 may be mounted to each form a separate angle .beta. 46 relative to the longitudinal axis 48 of the centerline of the tool 48 and a leading edge 49 of the comprising linear tapered section 40. Optionally, cutting elements 26 may be mounted with a combination of back rake and side rake. Each linear tapered section 40 comprises a top face 44, a leading face 50 and a trailing face 52. Each leading face 50 and top face 44 of a same linear tapered section 40 forms a leading edge 54. In addition, each trailing face 52 and top face 44 of a same linear tapered section 40 form a trailing edge 56.

In a preferred embodiment, cutting elements 26 are mounted with an increasing degree of back and side rake as the top face 44 of linear tapered section 40 rises away from the tool body (12 of FIG. 1). Mounting cutting elements 26 in this fashion allows for an improved balance of cutting action and reduced cutter wear. Those of skill in the art will recognize that, if cutting elements 26 are mounted with a "press-fit" as is common in prior art cutters, contact with the well bore can, and probably will, cause the cutting elements 26 to rotate or shift within their mounting holes, altering the back or side rake of cutting elements 26 and defeating the goal of the original mounting positions. For this reason, it is preferred that cutting elements 26 are mounted by brazing them into their desired positions.

Figure 2B:
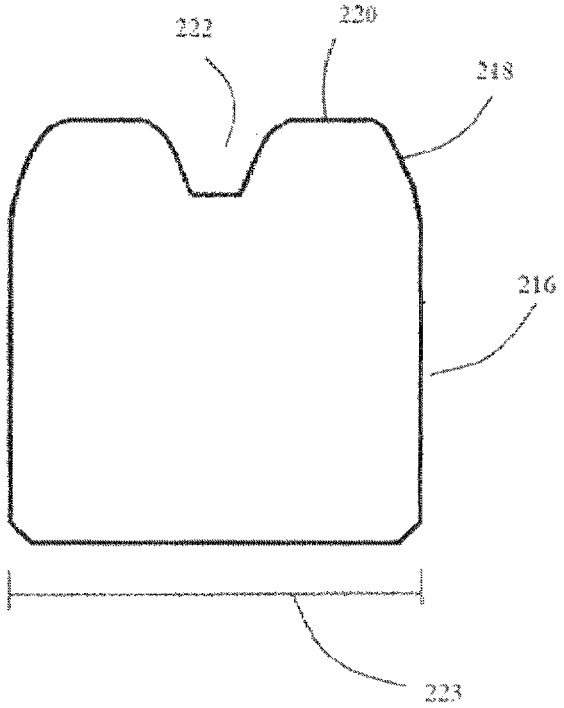
FIG. 2B is a schematic cross-sectional side view of a tungsten carbide cutting element of the present invention.
Figure 2C:
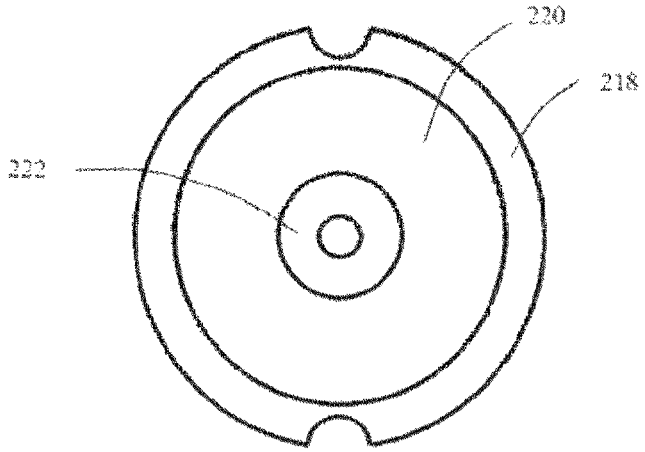
FIG. 2C is a schematic top view of a tungsten carbide cutting element of the present invention.

Referring to FIGS. 2A, 2B, and 2C, a prior art tungsten carbide cutter (FIG. 2A) is compared to the preferred tungsten carbide cutter of the present invention (FIGS. 2B and 2C). Typical prior art tungsten carbide cutters 210 characteristically provide angled sides 212 leading to a flat top 214. The preferred tungsten carbide cutter of the present invention 216 provides angled sides 218 leading to a flat top 220, but additionally provides a depression 222 in the center of each cutter. This design allows the cutters 216 to be larger than prior art cutters 210, with additional cutting edges and allowing for better carbide distribution.

Figure 2E:
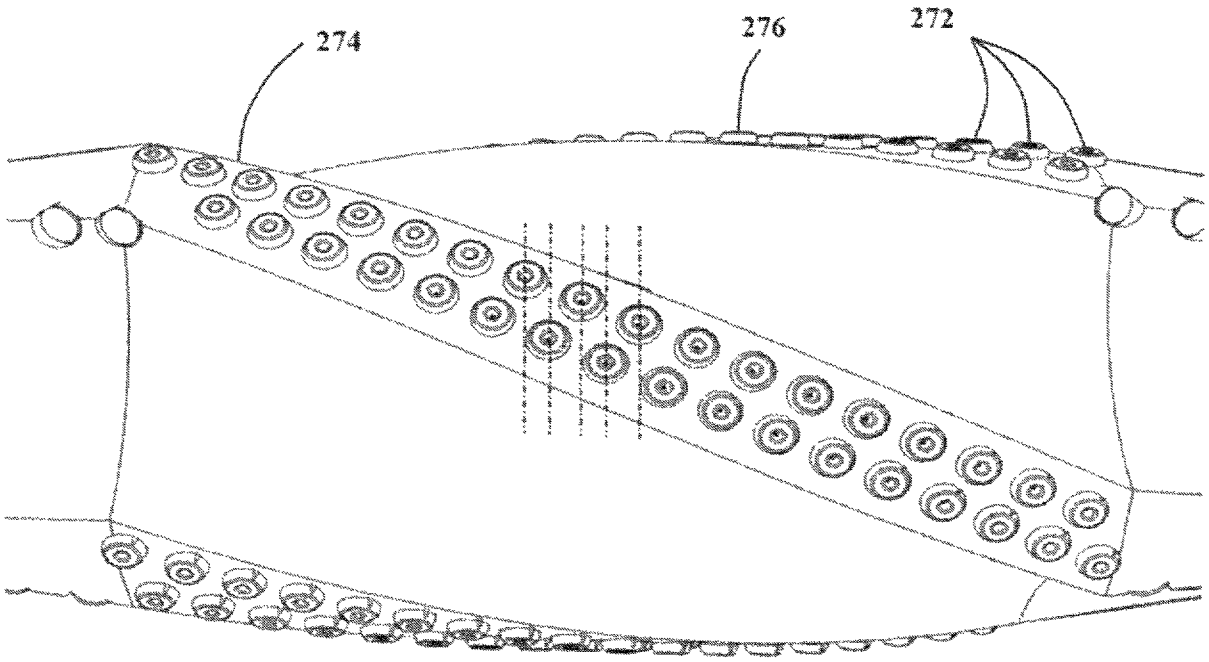
FIG. 2E is a schematic representation of the placement of tungsten carbide cutting elements of the present invention.

Referring to FIGS. 2D and 2E, typical carbide distributions for prior art reaming tools and the tool of the present invention, respectively, are shown. As reflected in FIG. 2D, prior art tools comprise carbide cutting elements 262 arrayed in effectively linear (or spiral), evenly spaced rows 264, resulting in a carbide distribution across the cutting face of the tool that "chops," or has gaps in the surface distribution of the effective cutting surface. (That is, the height of the effective cutting surface relative to the surface of the blade on which the cutters are mounted). Such a distribution of the effective cutting surface results in uneven and excessive wear to the cutting elements, as well as non-uniform reaming of the well bore.

Referring to FIG. 2E, the preferred arrangement of second cutting elements 272 is shown schematically. Rather than being arranged in simple rows and columns as is conventional, second cutting elements 272 are preferably arranged along constant radius spiral section 274 so that there is a substantially uniform distribution (dashed lines are provided for illustration) of the cutting surface around the circumference 276 of the tool. This distribution provides a more uniform cutting surface than prior art reamers.

As reflected in FIGS. 3A, 3B, 3C, and 3D, the carbide cutting element distribution of FIG. 2E provides a more uniform cutting surface against the well bore, which will improve cutting action and reduce strain on the tool. FIG. 3A presents a plot 310 of the carbide density 312 down the length of the tool body 314 for a prior art tool, including prior art cutting elements and cutting element distribution scheme. As reflected in plot 310, the carbide density along a prior art tool can vary tremendously, resulting in uneven cutting and strain on the tool, as well as the drill string.

FIG. 3B presents a plot 312 of carbide density for the same prior art cutting elements, but utilizing the distribution scheme of the present invention. In comparison to FIG. 3A, the variations in carbide density are reduced, but are still significant.

FIG. 3C presents a plot 314 of carbide density for a reaming tool using the cutting elements of the present invention (FIGS. 2B and 2C), but with a prior art distribution scheme. The use of the cutting elements of the present invention provides some improvement over the prior art due to the additional cutting surfaces provided.

FIG. 3D presents a plot 316 of carbide density for a reaming tool of the present invention, using both the improved cutting elements and the improved distribution scheme. As reflected in FIG. 3D, the variance in the carbide density distribution is significantly reduced over the prior art.

The preferred distribution of cutting elements may be determined empirically, such as by using a spreadsheet to graphically display the carbide distribution resulting when varying factors such as cutting bit spacing, cutting bit diameter, and, in the preferred embodiment of the present invention, the diameter of depression 222 (FIGS. 2B and 2C) in the cutting elements. In a preferred embodiment, the variation in carbide distribution will vary no more than +/−15% of the median carbide distribution (as a function of blade thickness). For example, if the average carbide distribution is 50%, the preferred range of carbide distribution would be 35% to 65%. Those of skill in the art will understand that the cutter distribution on each of the blades 20 (FIG. 1) need not be identical, and may be varied as needed to provide an effectively uniform carbide cutting surface against the well bore.

I claim:

1. A reamer for use in a downhole environment, comprising:

an annular body extending linearly along a central longitudinal axis between a first end and a second end;

at least one cutting blade coupled to the annular body and extending radially from the central longitudinal axis and comprising:

a spiral section extending helically about and distally from the annular body;

a first linear tapered section positioned between the spiral section and the first end, the first linear tapered section extending linearly from the first end and toward the spiral section, the first linear tapered section comprising a leading face, a top face and a trailing face, the leading face and the top face forming a linear leading edge and the top face and the trailing face forming a linear trailing edge, wherein the leading edge and the trailing edge rise increasingly away from the central longitudinal axis in extending toward the spiral section, and the leading edge and the trailing edge additionally converge toward each other in extending from the spiral section and toward the first end;

a second linear tapered section positioned between the spiral section and the second end, the second linear tapered section extending linearly from the second end and toward the spiral section, the second linear tapered section comprising a second leading face, a second top face and a second trailing face, the second leading face and the second top face forming a second linear leading edge and the second top face and the second trailing face forming a second linear trailing edge, wherein the second leading edge and the second trailing edge rise increasingly away from the central longitudinal axis in extending toward the spiral section, and the second leading edge and the second trailing edge additionally converge toward each other in extending from the spiral section and toward the second end, wherein the first linear tapered section and the second linear tapered section comprise a plurality of first cutting inserts, and said spiral section comprises a plurality of second cutting inserts and at least one second cutting insert of the plurality of second cutting inserts comprises a top surface positioned distally from the central longitudinal axis, and a center depression in the top surface of the second insert defining the center depression and the center depression extending toward the central longitudinal axis.

2. The reamer of claim 1, wherein at least one first cutting insert of the plurality of first cutting inserts comprises polycrystalline diamond.

3. The reamer of claim 1 wherein the plurality of second cutting inserts are distributed along the spiral section.

4. The reamer of claim 2, wherein at least one first cutting insert of the plurality of first cutting inserts is mounted on the at least one cutting blade with side rake.

5. The reamer of claim 1, wherein the at least one second cutting insert of the plurality of second cutting inserts comprises tungsten carbide.

6. The reamer of claim 5, wherein each of the second cutting inserts of the plurality of second cutting inserts comprises a top surface positioned distally from the central longitudinal axis, and a center depression in the top surface defining the center depression and the center depression extending toward the central longitudinal axis.

7. The reamer of claim 5, wherein the plurality of second cutting inserts are distributed along the spiral section.

8. The reamer of claim 1, wherein each of the second cutting inserts of the plurality of second cutting inserts comprises a top surface positioned distally from the central longitudinal axis, and a center depression in the top surface defining the center depression and the center depression extending toward the central longitudinal axis.

9. The reamer of claim 2, wherein at least one first cutting insert of the plurality of first cutting inserts is mounted on the at least one cutting blade with a back rake.

10. The reamer of claim 1, wherein at least one first cutting insert of the plurality of first cutting inserts is mounted on the at least one cutting blade with a back rake.

11. The reamer of claim 1, wherein at least one first cutting insert of the plurality of first cutting inserts is mounted on the at least one cutting blade with side rake.

12. The reamer of claim 1, wherein the first linear tapered section extends longitudinally in parallel with the central longitudinal axis.

13. The reamer of claim 12, wherein the second linear tapered section extends longitudinally in parallel with the central longitudinal axis.

* * * * *